US010202226B1

(12) United States Patent
Schultz

(10) Patent No.: US 10,202,226 B1
(45) Date of Patent: Feb. 12, 2019

(54) LID WITH HIDDEN STACKING

(71) Applicant: Plastic Ingenuity, Inc., Cross Plains, WI (US)

(72) Inventor: Joseph L. Schultz, Madison, WI (US)

(73) Assignee: PLASTIC INGENUITY, INC., Cross Plains, WI (US)

( * ) Notice: Subject to any disclaimer, the term of this patent is extended or adjusted under 35 U.S.C. 154(b) by 8 days.

(21) Appl. No.: 15/072,931

(22) Filed: Mar. 17, 2016

(51) Int. Cl.
*B65D 51/24* (2006.01)
*B65D 43/02* (2006.01)
*B65D 21/02* (2006.01)

(52) U.S. Cl.
CPC ..... *B65D 51/24* (2013.01); *B65D 21/0217* (2013.01); *B65D 43/02* (2013.01); *B65D 2543/00027* (2013.01)

(58) Field of Classification Search
CPC ..... B65D 51/24; B65D 43/02; B65D 2543/00027; B65D 21/0233; B65D 21/0217; B65D 21/064; B65D 21/022; B65D 21/0222
USPC ..... 220/380, 4.26; 206/508, 515, 519, 505
See application file for complete search history.

(56) References Cited

U.S. PATENT DOCUMENTS 3,407,961 A * 10/1968 Box ..... A01K 31/002 206/511
3,759,416 A * 9/1973 Constantine ..... B65D 21/0219 206/505
3,773,207 A * 11/1973 Dokoupil ..... B65D 43/0254 220/266
4,718,571 A * 1/1988 Bordner ..... B65D 21/022 206/508
5,419,451 A * 5/1995 Bitel, Jr. ..... B65D 1/36 206/508
2009/0173656 A1* 7/2009 Furlong ..... B65D 21/022 206/508

* cited by examiner

*Primary Examiner* — Robert J Hicks
(74) *Attorney, Agent, or Firm* — Rick L. Abegglen

(57) ABSTRACT

A kit of thermoformed lids comprising a three lids which are substantially similar except for specific differences in four stacking areas located at the corners of the lids. Unlike prior art lids that use convex external lugs to provide separation during stacking, lids according to the present invention have stacking areas formed as interruptions in concave channels located along the peripheries of the lids, improving the appearance and uniformity of products comprising the lids.

15 Claims, 15 Drawing Sheets

LID WITH HIDDEN STACKING

FIELD OF THE INVENTION

This invention relates generally to the field of thermoformed objects and containers. More particularly, the present invention relates to thermoformed lids having features that enhance stacking, separability, and uniformity when multiple lids are nested and stacked together.

BACKGROUND OF THE INVENTION

Thermoformed plastic containers are well known as inexpensive and highly customizable containers for the sale of a wide variety of products, everything from cell phones to deli meats. Thermoformed plastic containers are typically transparent and rigid, so they can give a consumer the ability to examine a product closely. They can be made tamper-resistant, to reduce the risk that the product could be damaged or contaminated. They are typically lightweight, and can be manufactured in a wide variety of shapes for different uses, such as cups, plates, deli trays, or as lids or covers for any of these common shapes.

Thermoformed plastic objects, such as lids or covers for deli containers (hereafter "lids") are typically nested and stacked together as they come off the line at the end of a continuous feed manufacturing process. If the lids were all completely identical, they would nest together perfectly and engage their surfaces almost entirely. This level of engagement between adjacent lids can be problematic because the lids are made of relatively soft and hot plastic (having been just thermoformed at high temperature). If the lids stick together, that can cause manufacturing problems such as line stoppages and/or scrap.

To avoid the problems associated with perfect engagement between identical lids in a stack, lids have been made with convex external protrusions or lugs that differ for adjacent lids in the stack. This prevents the adjacent lids from nesting together, creating a vertical space between adjacent lids in the stack. The right amount of vertical space can keep adjacent lids in the stack from sticking together, it can aid outgassing and rapid and uniform cooling of the plastic lid at the end of the thermoforming process, and it can aid separability at the eventual point of use. However, too much space between adjacent lids can reduce efficiency in storage and transportation, so there is a tradeoff between tight stacking for efficiency and loose stacking for separability.

In practice, some consumers find the convex external protrusions or lugs to be unsightly. Also, some consumers find the apparent differences between different units of the same product to be confusing. What is needed is a thermoformed lid with improved and hidden features that enhance stacking, separability, and uniformity when multiple lids are stacked together after manufacture, for storage or transport prior to their final use or sale.

SUMMARY OF THE INVENTION

A first embodiment of the invention is a kit of thermoformed lids comprising a first lid having a plurality of first stacking areas, each first stacking area formed as at least one first interruption at a first radial position in a first concave channel; a second lid having a plurality of second stacking areas, each second stacking area formed as at least one second interruption at a second radial position in a second concave channel; and a third lid having a plurality of third stacking areas, each third stacking area formed as at least one third interruption at a third radial position in a third concave channel; wherein the first radial position, the second radial position, and the third radial position differ from one another.

A second embodiment of the invention is a product case pack comprising a stack of thermoformed lids comprising a plurality of first lids with first stacking areas, each first stacking area formed as at least one first interruption at a first location in a first trench; a plurality of second lids with second stacking areas, each second stacking area formed as at least one second interruption at a second location in a second trench; and a plurality of third lids with third stacking areas, each third stacking area formed as at least one third interruption at a third location in a third trench; wherein the first location, the second location, and the third location differ from one another.

Compared to the prior art which uses convex external protrusions or lugs to provide stacking separation, a lid according to my invention can provide stacking separation without the use of structures that are readily apparent to the end consumer, thereby enhancing the aesthetics, general smoothness, and uniform appearance of products comprising the lid. Although there are still differences between different units of the same product, with my lid those differences are relatively subtle and much less noticeable.

A lid according to my invention can also achieve a greater maximum vertical separation distance. The prior art lids discussed below use convex external protrusions or lugs along with a second structure, a lower side wall and periphery, to provide stacking separation. The overall height of the prior art lid is the lug height (the stacking separation) plus the height of that second structure, so the stacking separation has to be less than the total vertical height. In contrast, a lid according to my invention can theoretically provide stacking separation almost the entire vertical height of the lid, by making the channel, trench, or valley depth equal to the entire vertical height of the lid.

A lid according to my invention has stacking structures that are relatively compact in contact surface area (between adjacent lids in the stack) compared to the prior art. The reduced contact surface area reduces adhesion, and makes it less likely that adjacent lids will stick together as they come off the thermoforming line and or during humid conditions.

The compactness of the stacking structure in my invention can enable a wider number of permutations of the stacking structure in a given area, compared to the relatively large convex external lugs of prior art lids. The lugs in prior art lids were relatively large, so only a few permutations (three or four) could fit in the available space. With such a small number permutations, during the course of use there could be a relatively large (⅓ or ¼) chance of stacking two identical lids on top of one another, resulting in the very problem the stacking structure was supposed to avoid. My stacking structure could allow a factor of 10 or more greater number of different permutations, drastically reducing the odds of stacking two identical lids on top of one another.

Further objects, features, and advantages of the invention will be apparent from the following detailed description when taken in conjunction with the accompanying drawings.

DETAILED DESCRIPTION OF THE INVENTION

Figure 1A:
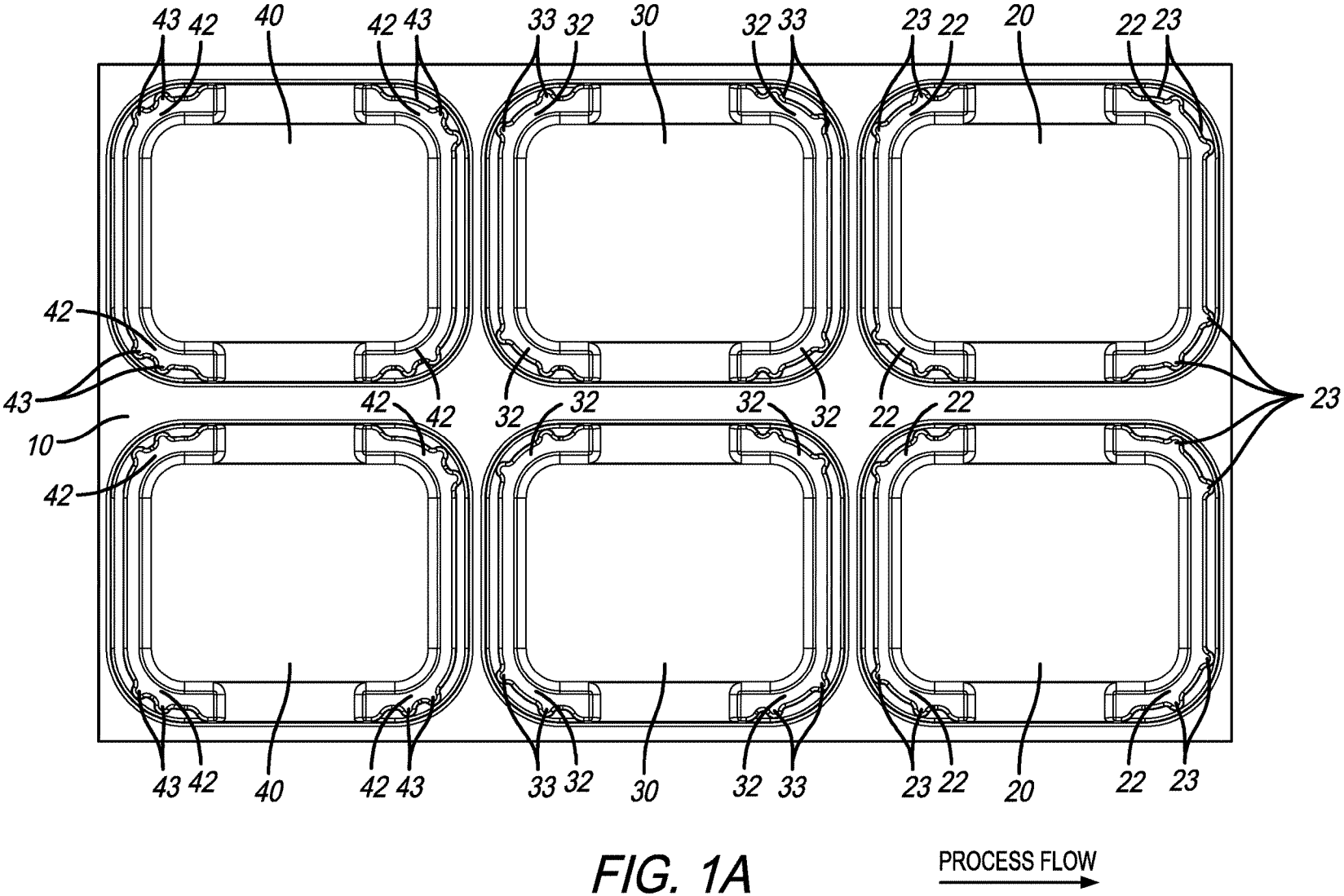
FIG. 1A is a plan view of a portion of a prior art sheet of thermoformed lids.
Figure 1B:
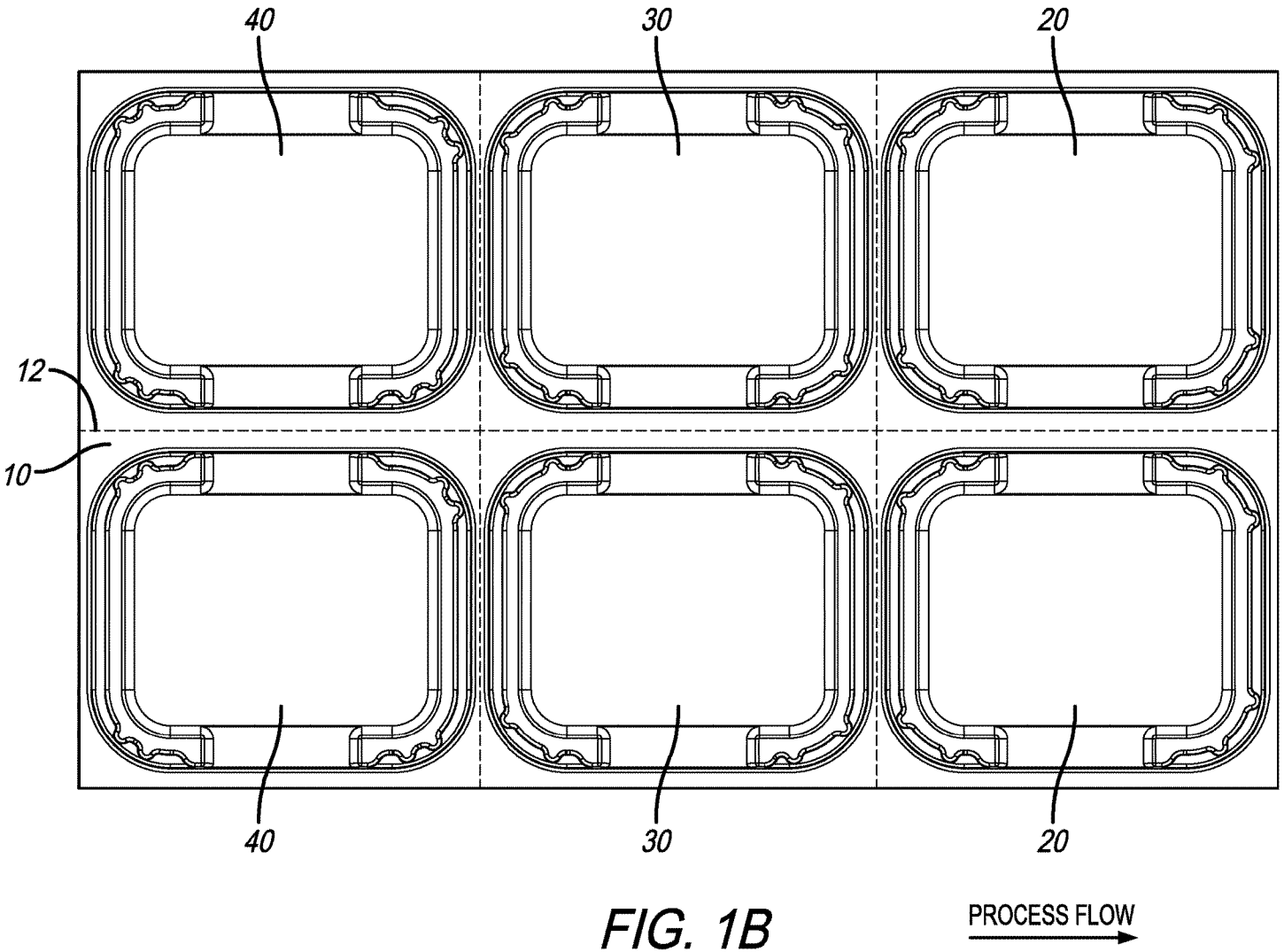
FIG. 1B is a plan view of the prior art sheet of thermoformed lids of FIG. 1A, with dotted lines added to show the approximate locations of the cuts used to separate the individual lids.
Figure 2A:
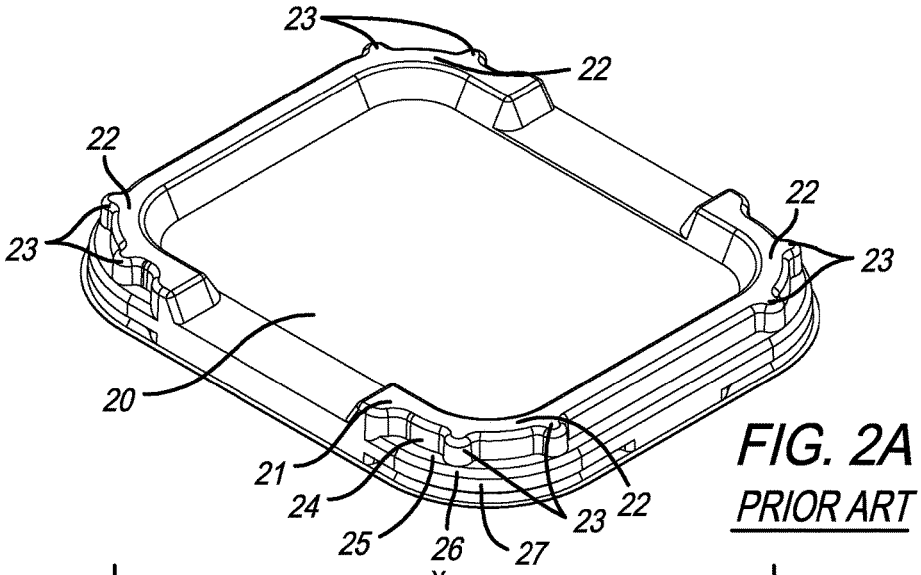
FIG. 2A PRIOR ART
FIGS. 2A, 2B, 2C, and 2D are perspective, top, first side, and second side views, respectively, of a first lid included in the prior art sheet of thermoformed lids of FIG. 1A.
Figure 2B:
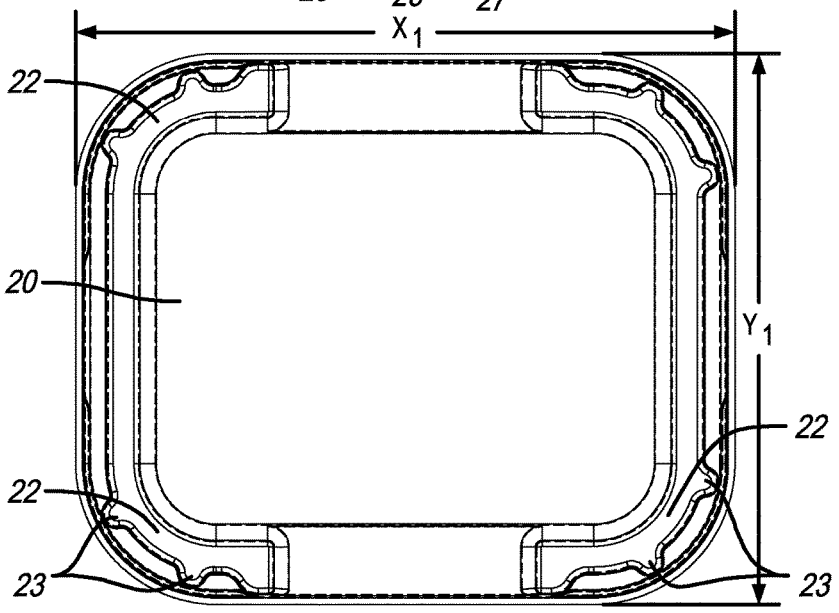
FIG. 2B PRIOR ART
Figure 2D:
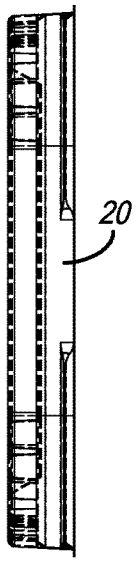
FIG. 2D PRIOR ART
Figure 2C:
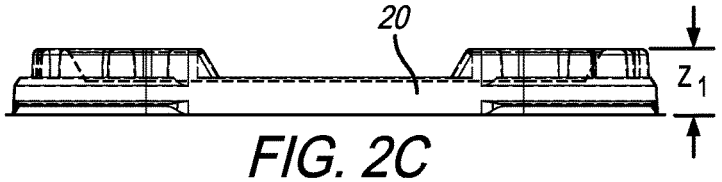
FIG. 2C PRIOR ART
Figure 2E:
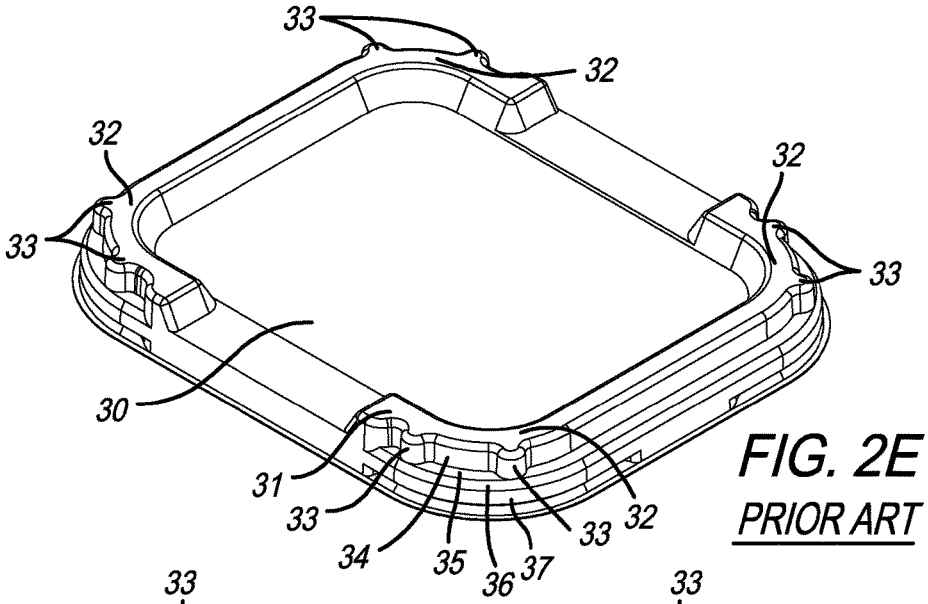
FIG. 2E PRIOR ART
FIGS. 2E, 2F, 2G, and 2H are perspective, top, first side, and second side views, respectively, of a second lid included in the prior art sheet of thermoformed lids of FIG. 1A.
Figure 2F:
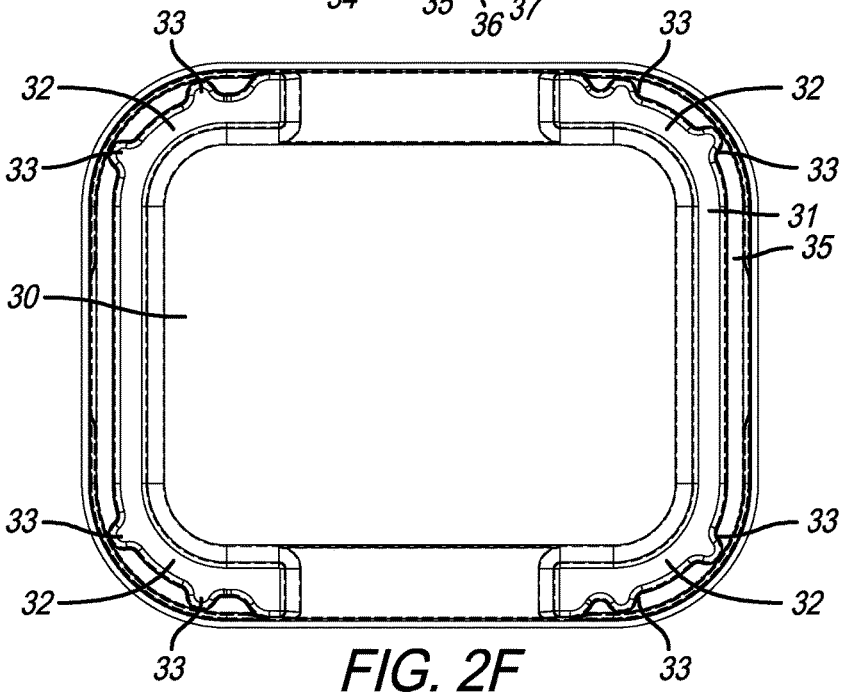
FIG. 2F PRIOR ART
Figure 2H:
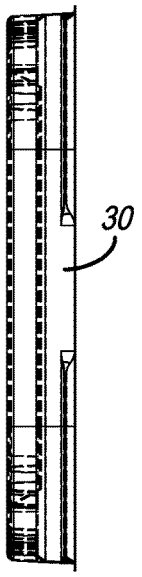
FIG. 2H PRIOR ART
Figure 2G:
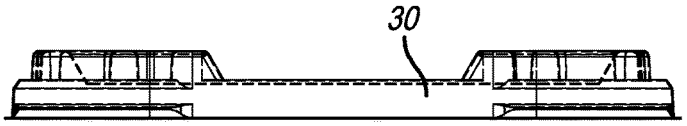
FIG. 2G PRIOR ART
Figure 2I:
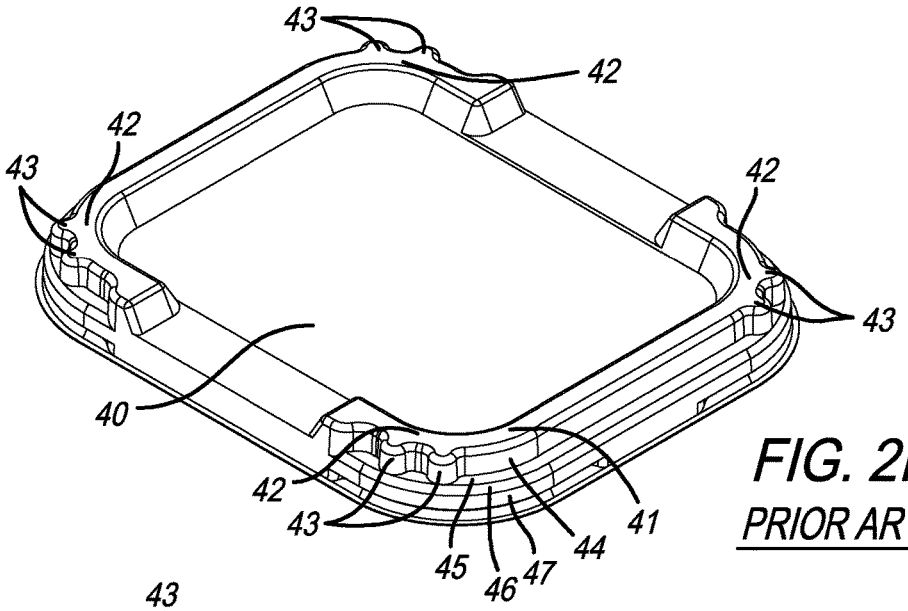
FIG. 2I PRIOR ART
FIGS. 2I, 2J, 2K, and 2L are perspective, top, first side, and second side views, respectively, of a third lid included in the prior art sheet of thermoformed lids of FIG. 1A.
Figure 2J:
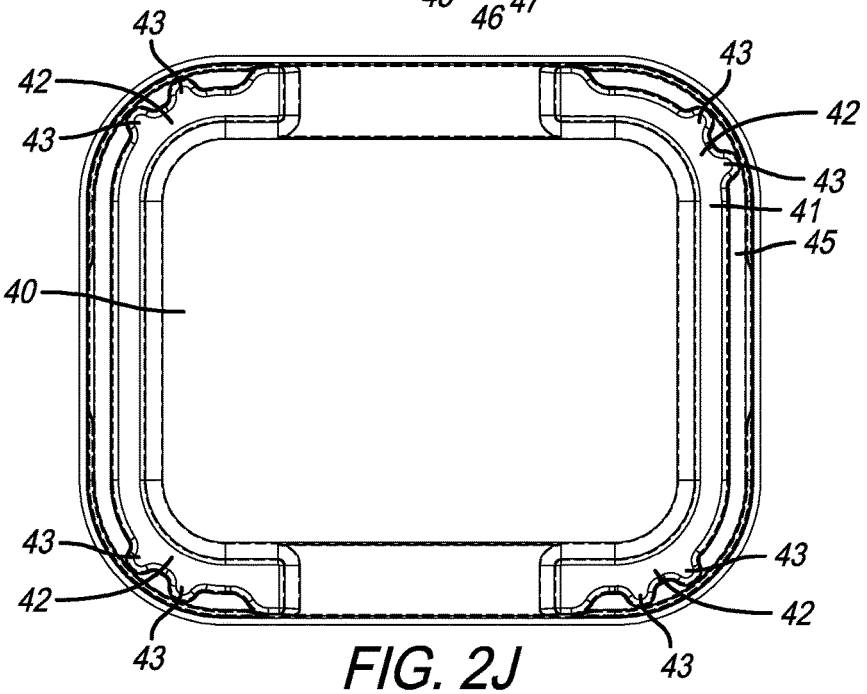
FIG. 2J PRIOR ART
Figure 2L:
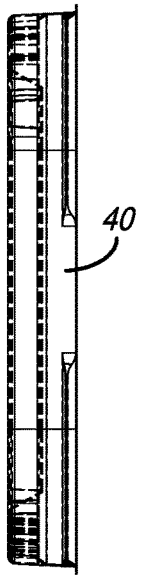
FIG. 2L PRIOR ART
Figure 2K:
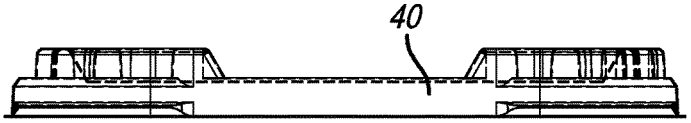
FIG. 2K PRIOR ART
Figure 3A:
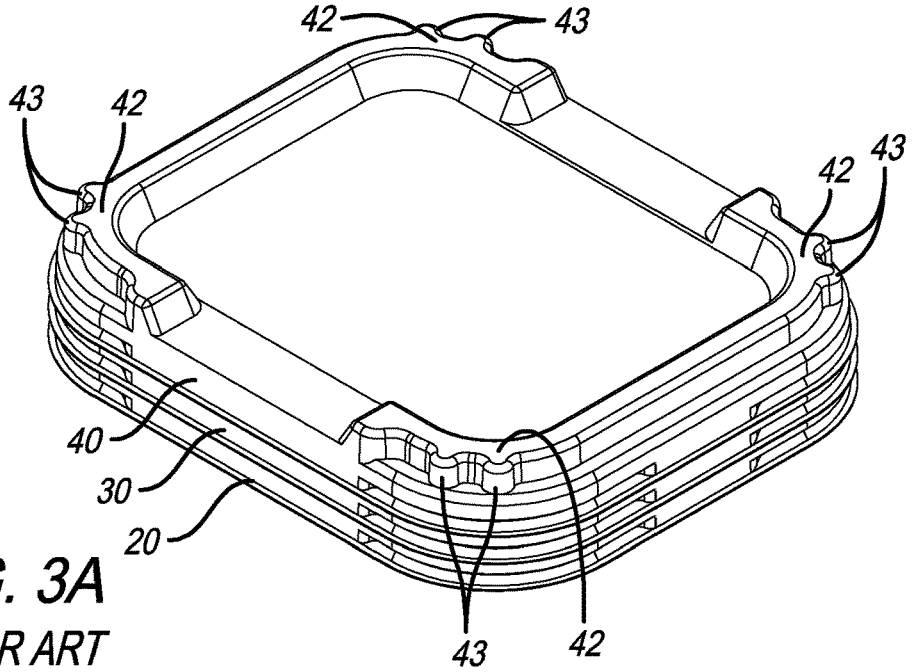
FIG. 3A PRIOR ART
FIG. 3A is a perspective view of a stack of the first, second, and third lids included in the prior art sheet of thermoformed lids of FIG. 1A.
Figure 3B:
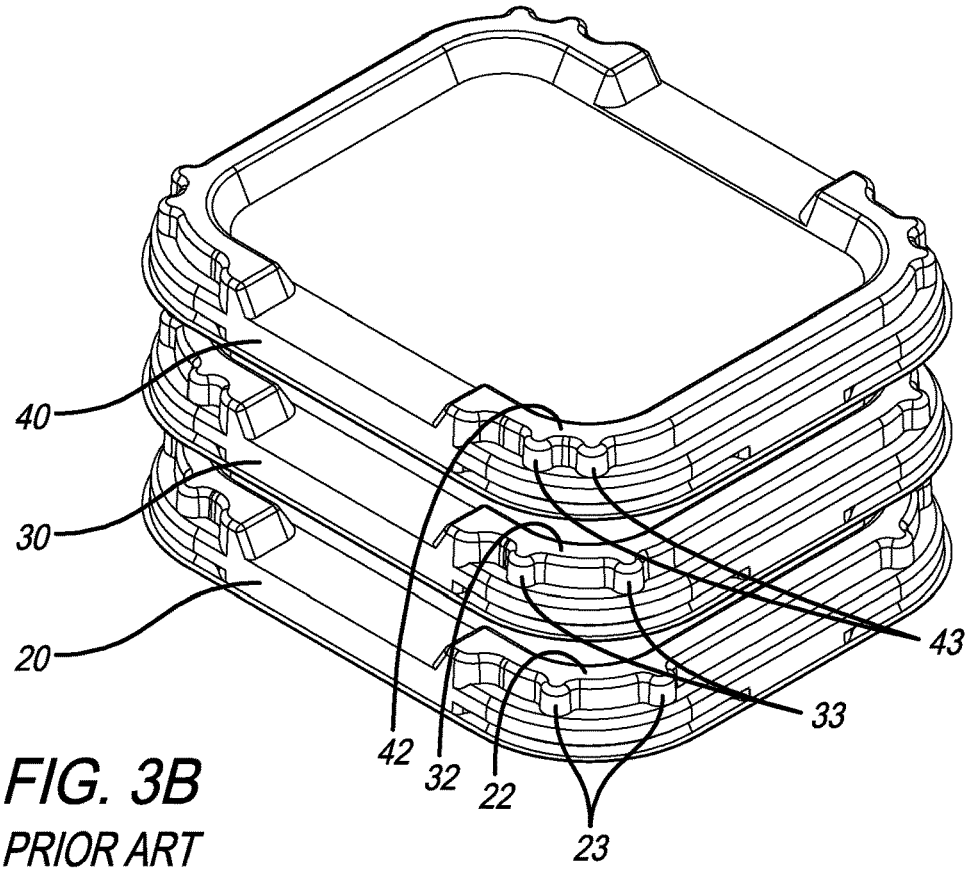
FIG. 3B PRIOR ART
FIG. 3B is an exploded perspective view of the stack of FIG. 3A.
Figure 3C:
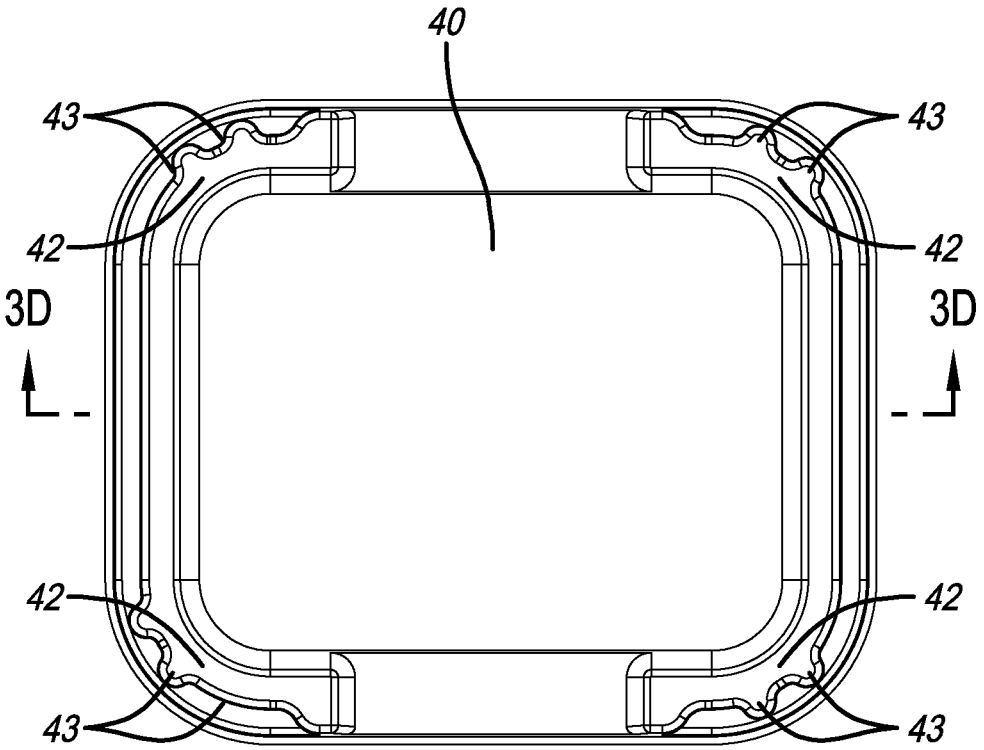
FIG. 3C PRIOR ART
FIG. 3C is a plan view of the stack of FIG. 3A.

FIGS. 1A-1B provide plan views of a portion of a prior art sheet 10 of thermoformed lids 20, 30 & 40, with FIG. 1B the same as FIG. 1A except for dotted lines added to show the approximate locations of the cuts 12 used to separate the individual lids 20, 30, & 40. As this portion of a prior art sheet 10 moves in the direction of process flow shown in FIGS. 1A & 1B, after the parts come off the line they will ordinarily form a stack 14 on top of one another with lid 20 on the bottom, followed by lid 30 in the middle, and lid 40 on top as shown in FIGS. 3A-3B.

As shown in FIGS. 2A-2D, the first prior art lid 20 has an upper periphery 21 with four stacking areas 22 located at the corners. Each stacking area 22 has a convex protrusion or lug 23 that juts or projects outwardly from an upper side wall 24. On each lateral side of the outward-projecting lug 23 is a shelf 25 which extends to a corner 26 and to a lower side wall and periphery 27.

Similarly, as shown in FIGS. 2E-2H, the second prior art lid 30 has an upper periphery 31 with four stacking areas 32 located at the corners. Each stacking area 32 has a convex protrusion or lug 33 that juts or projects outwardly from an upper side wall 34. On each lateral side of the outward-projecting lug 33 is a shelf 35 which extends to a corner 36 and to a lower side wall and periphery 37.

Lastly, as shown in FIGS. 2I-2L, the third prior art lid 40 also has an upper periphery 41 with four stacking areas 42 located at the corners. Each stacking area 42 has a convex protrusion or lug 43 that juts or projects outwardly from an upper side wall 44. On each lateral side of the outward-projecting lug 43 is a shelf 45 which extends to a corner 46 and to a lower side wall and periphery 47.

Figure 3D:
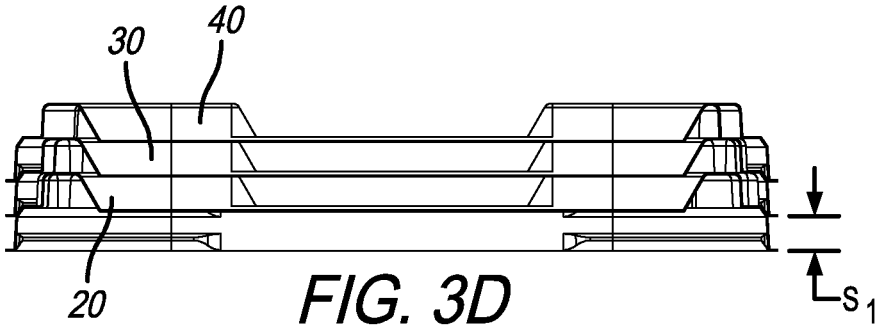
FIG. 3D PRIOR ART
FIG. 3D is a cross section of the stack of FIG. 3C, taken along the line 3D-3D thereof.

As perhaps best shown in FIGS. 3A-3B, the stacking areas 22, 32, & 42 of the lids 20, 30, & 40, respectively, differ from one another in the placement of the different convex lugs 23, 33, & 43. When the lids 20, 30, & 40 are stacked, the respective stacking areas 22, 32, & 42 can't nest together, with the interference creating a definite space S1 (shown in FIG. 3D) between adjacent lids in the stack. The contact area between the adjacent lids 20, 30 & 40 is approximately the upward-facing surface area of the lugs 23, 33, & 43.

Figure 4A:
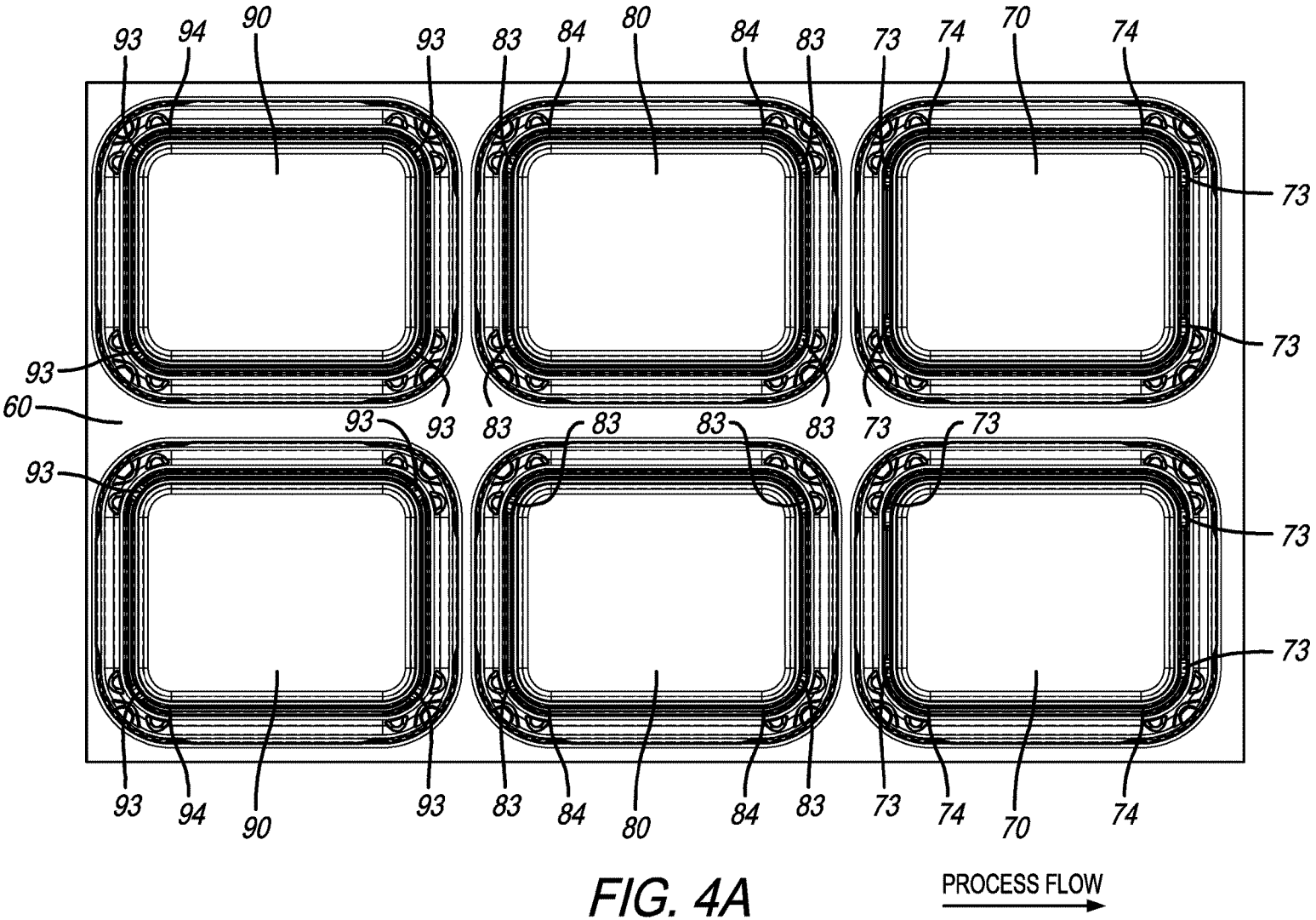
FIG. 4A is a plan view of a portion of a sheet of thermoformed lids according to my invention.
Figure 4B:
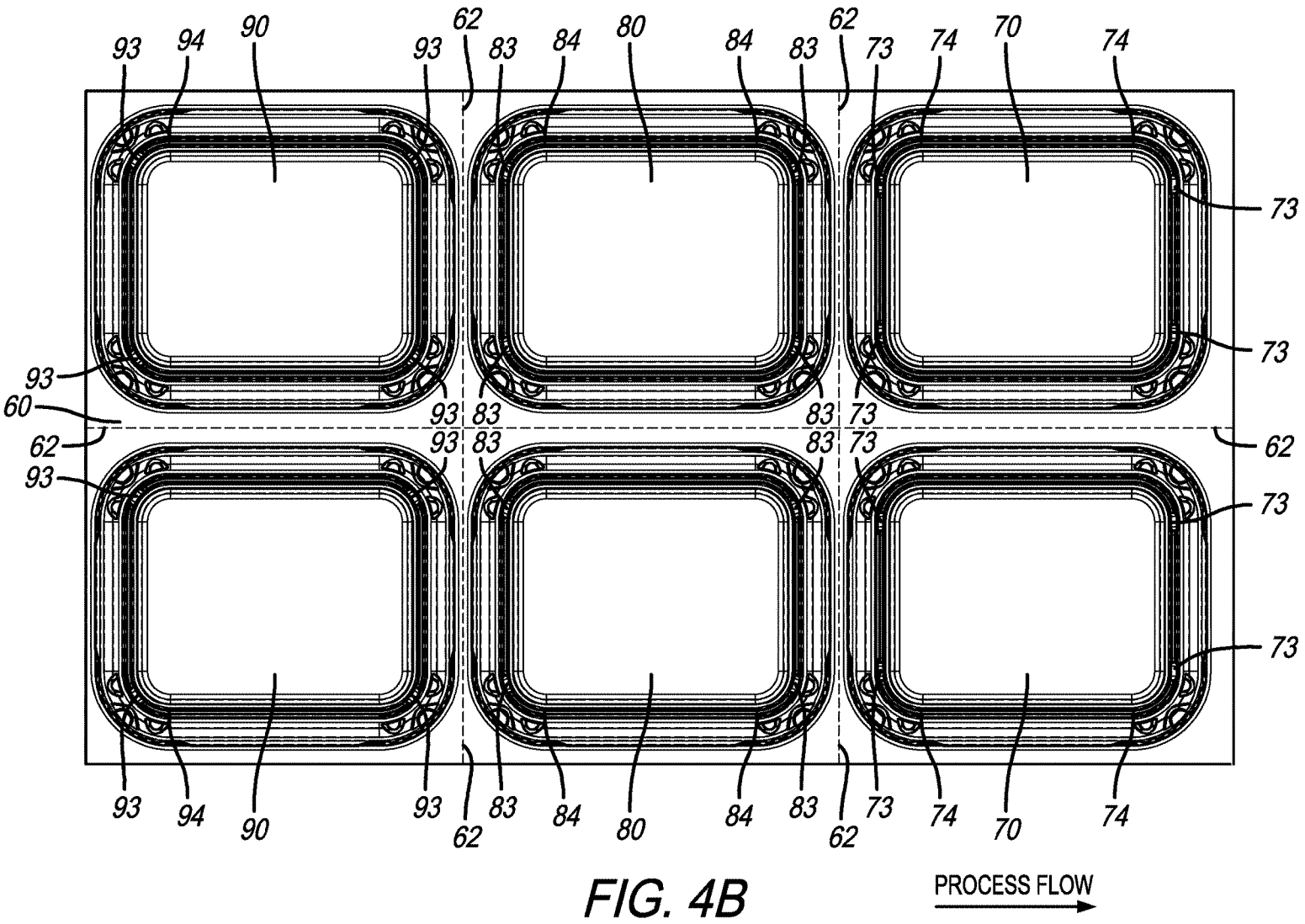
FIG. 4B is a plan view of the sheet of thermoformed lids of FIG. 4A, with dotted lines added to show the approximate locations of the cuts used to separate the individual lids.
Figure 6A:
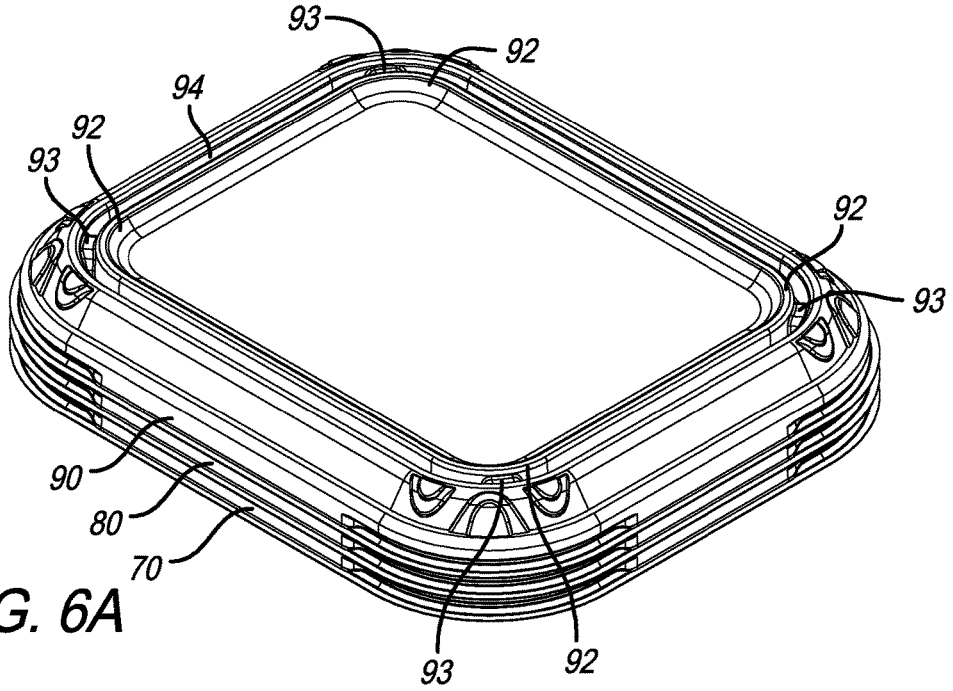
FIG. 6A is a perspective view of a stack of the first, second, and third lids included in the prior art sheet of thermoformed lids of FIG. 4A.
Figure 6B:
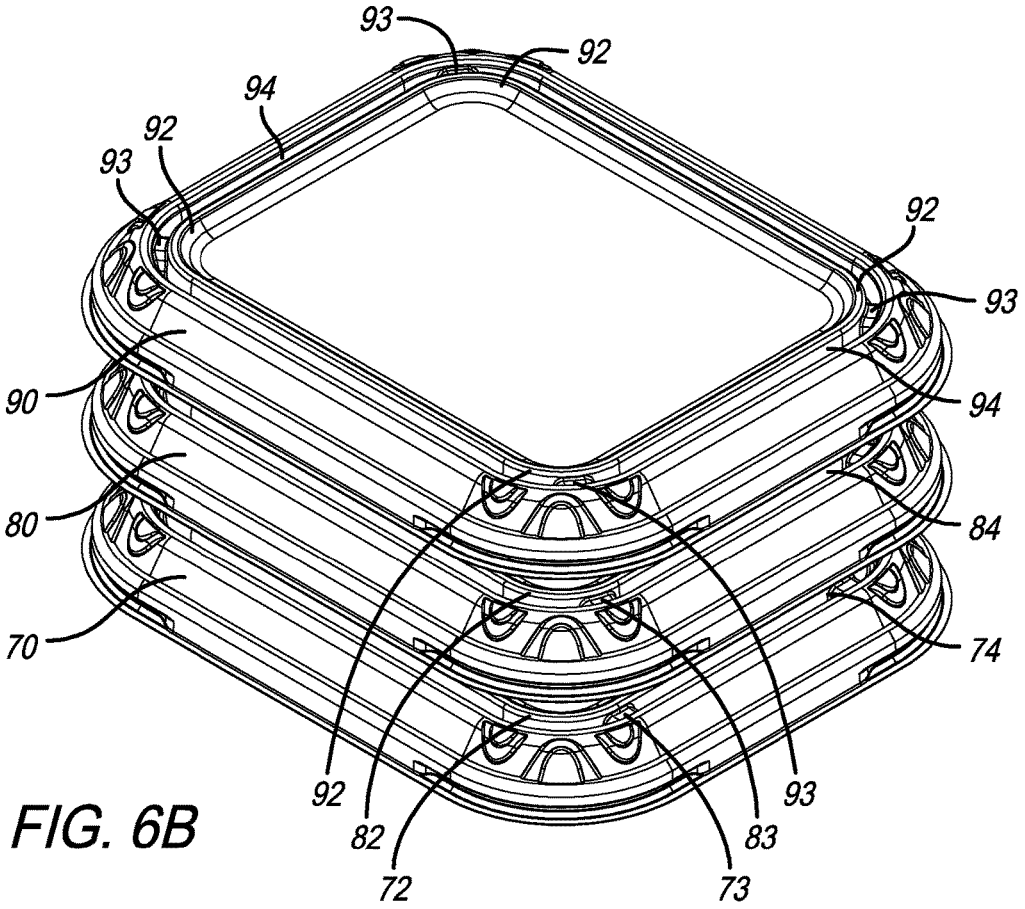
FIG. 6B is an exploded perspective view of the stack of FIG. 6A.
Figure 6C:
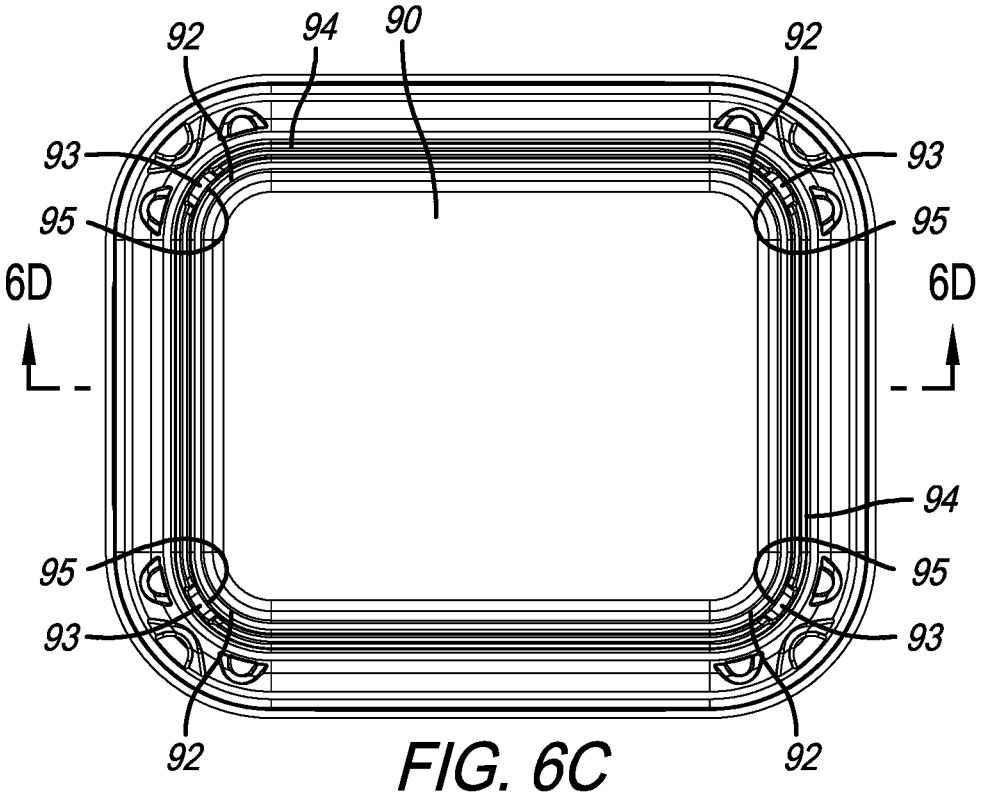
FIG. 6C is a plan view of the stack of FIG. 6A.

FIGS. 4A-4B provide plan views of a portion of a sheet 60 of thermoformed lids 70, 80 & 90 according to my invention, with FIG. 4B the same as FIG. 4A except for dotted lines added to show the approximate locations of the cuts 62 used to separate the individual lids 70, 80, & 90. As this portion of a sheet 60 moves in the direction of process flow shown in FIGS. 4A & 4B, after the parts come off the line they will ordinarily form a stack 64 on top of one another with lid 70 on the bottom, followed by lid 80 in the middle, and lid 90 on top as shown in FIGS. 6A-6B.

Unlike the prior art lids 20, 30 & 40, the lids 70, 80 & 90 do not contain any convex protrusions or lugs 23, 33, & 43. Instead, to provide separation during stacking the lids 70, 80, & 90 include concave channels 74, 84, & 94 with interruptions 73, 83, & 93.

As shown in FIGS. 5A-5D, the first lid 70 according to my invention has a center 71 and an upper periphery with four stacking areas 72 located at the corners. Each stacking area 72 is formed as an interruption 73 in a concave channel 74 running along the upper periphery. The interruptions 73 are at locations 75 which correspond to angular positions A1 and radial positions R1.

Similarly, as shown in FIGS. 5E-5H, the second lid 80 according to my invention has a center 81 and an upper periphery with four stacking areas 82 located at the corners. Each stacking area 82 is formed as an interruption 83 in a concave channel 84 running along the upper periphery. The interruptions 83 are at locations 85 which correspond to angular positions A2 and radial positions R2.

Lastly, as shown in FIGS. 5I-5L, the third lid 90 according to my invention has a center 91 and an upper periphery with four stacking areas 92 located at the corners. Each stacking area 92 is formed as an interruption 93 in a concave channel 94 running along the upper periphery. The interruptions 93 are at locations 95 which correspond to angular positions A3 and radial positions R3.

Figure 5A:
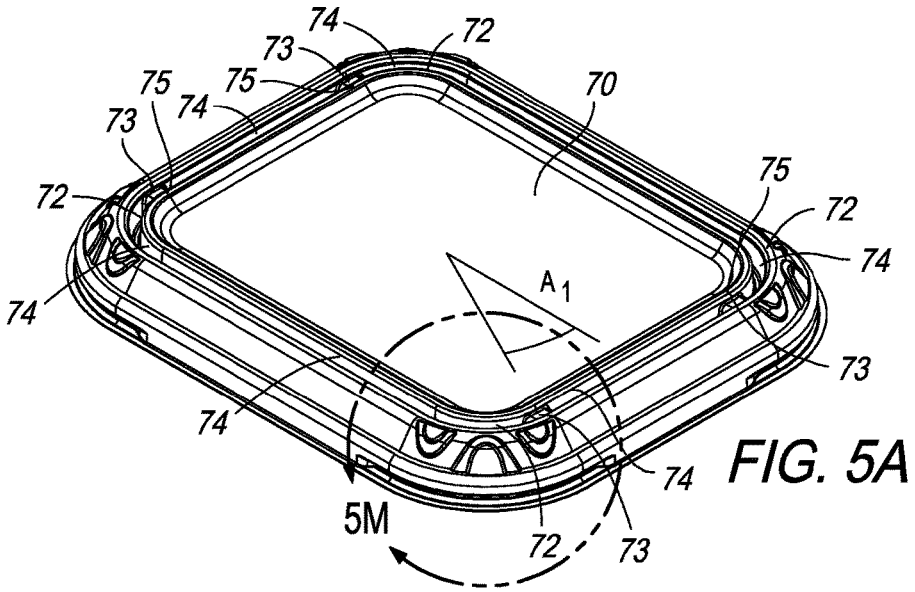
FIGS. 5A, 5B, 5C, and 5D are perspective, top, first side, and second side views, respectively, of a first lid included in the thermoformed lids of FIG. 4A.
Figure 5B:
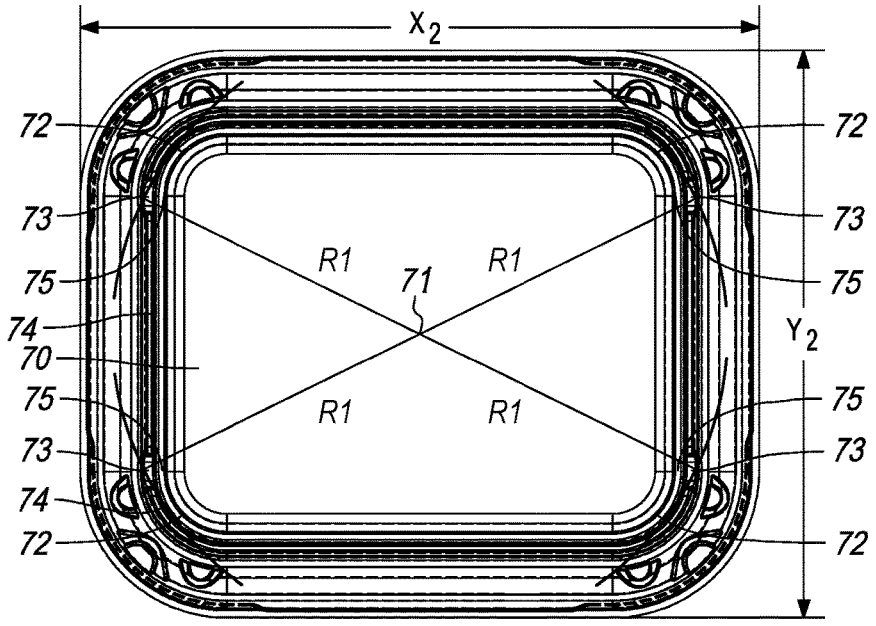
Figure 5D:
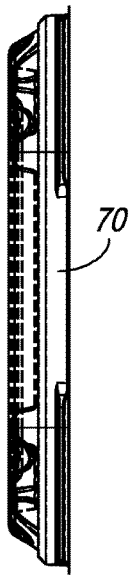
Figure 5C:
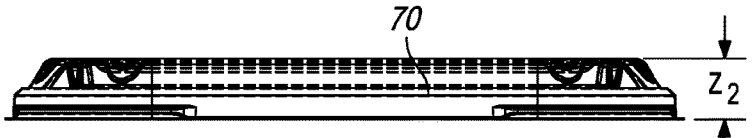
Figure 5E:
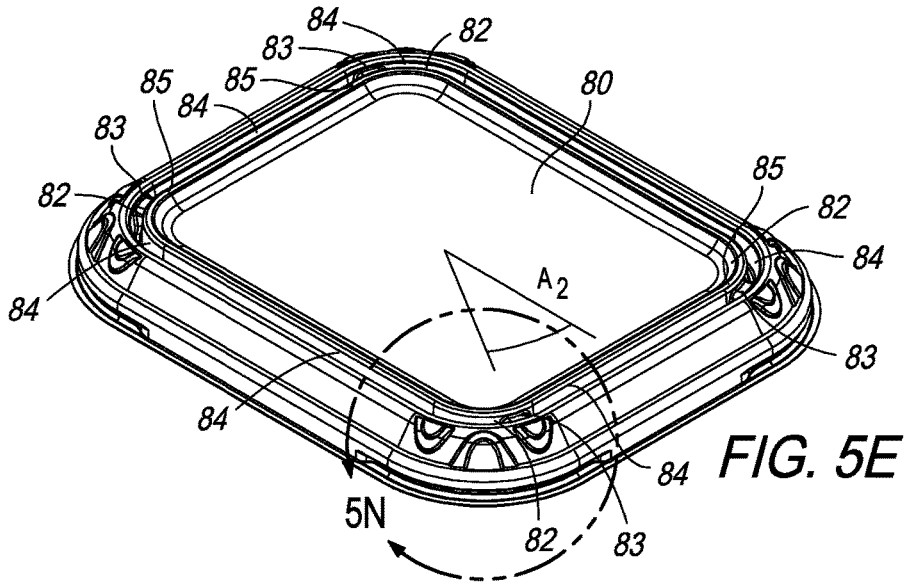
FIGS. 5E, 5F, 5G, and 5H are perspective, top, first side, and second side views, respectively, of a second lid included in the thermoformed lids of FIG. 4A.
Figure 5F:
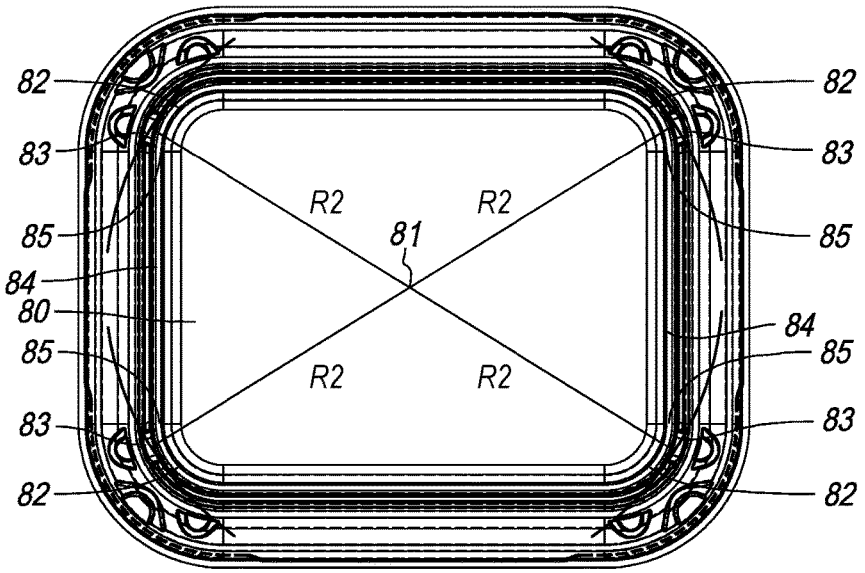
Figure 5H:
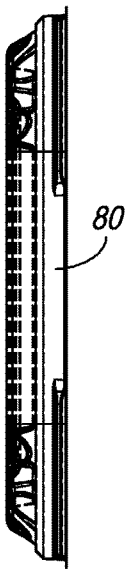
Figure 5G:
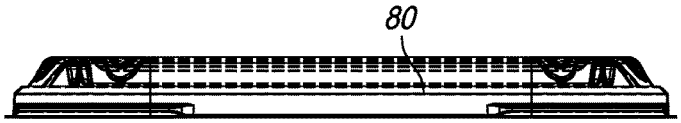
Figure 5I:
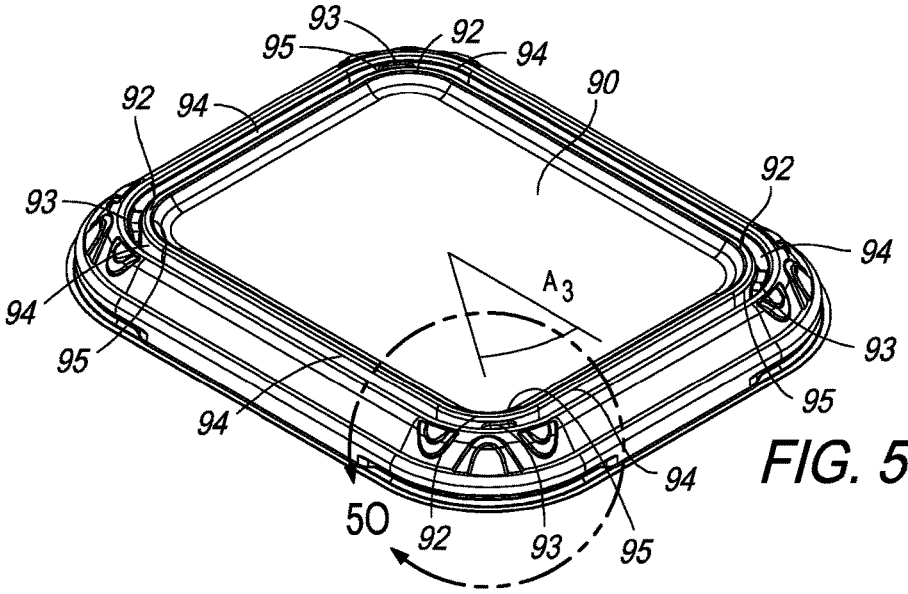
FIGS. 5I, 5J, 5K, and 5L are perspective, top, first side, and second side views, respectively, of a third lid included in the thermoformed lids of FIG. 4A.
Figure 5J:
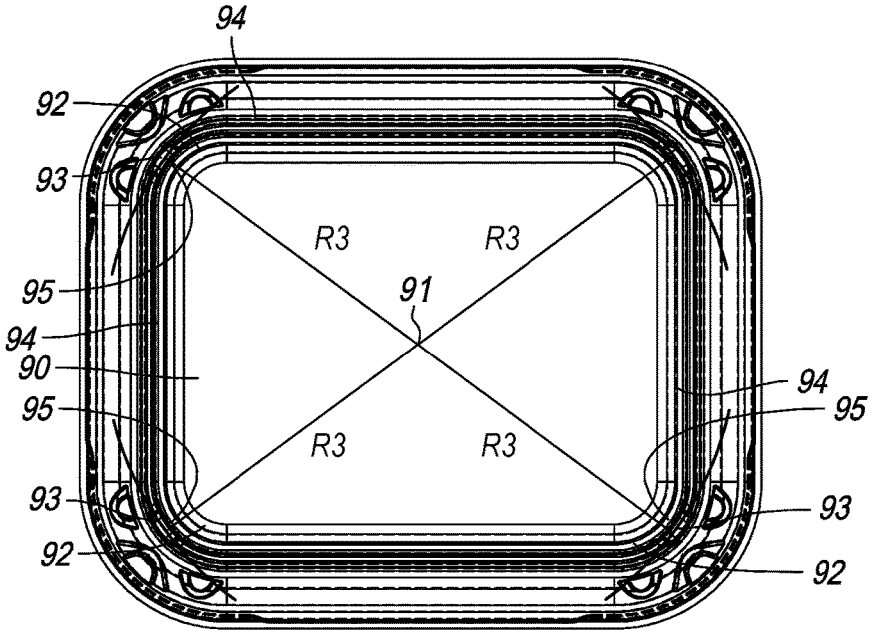
Figure 5L:
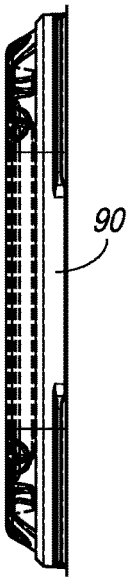
Figure 5K:
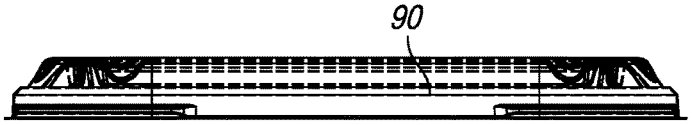
Figure 5M:
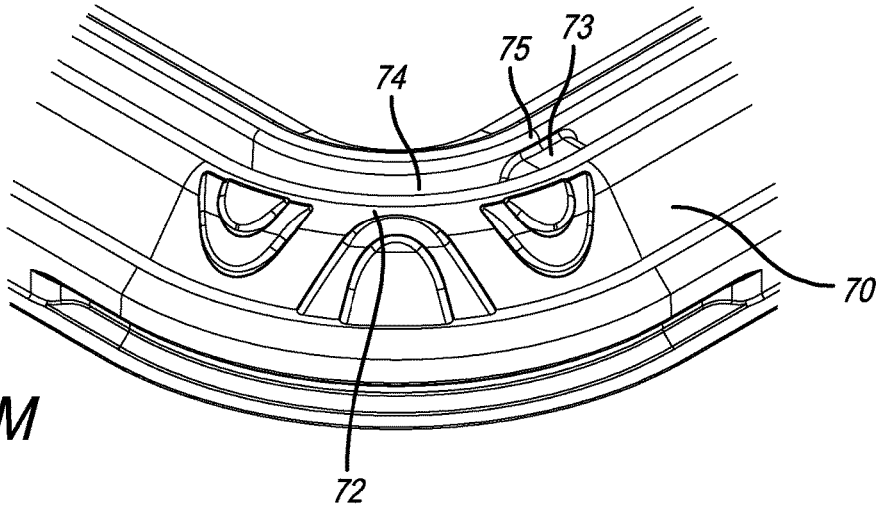
FIGS. 5M, 5N, and 5O are zoomed in portions of FIGS. 5A, 5E, and 5I, respectively, showing details of the novel stacking structure according to my invention.
Figure 5N:
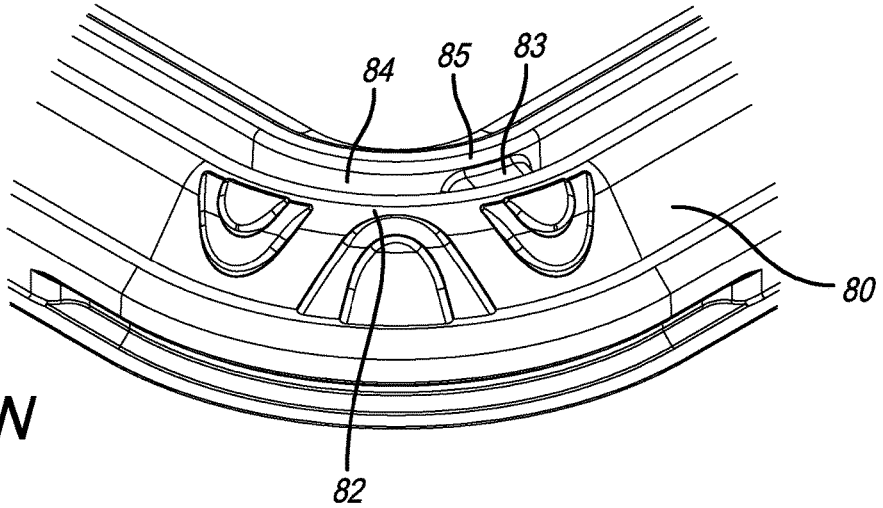
Figure 5O:
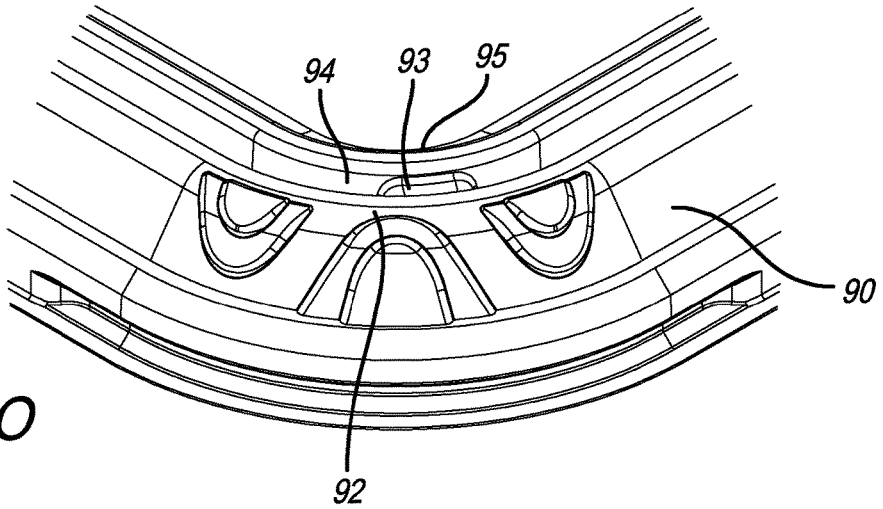
Figure 6D:
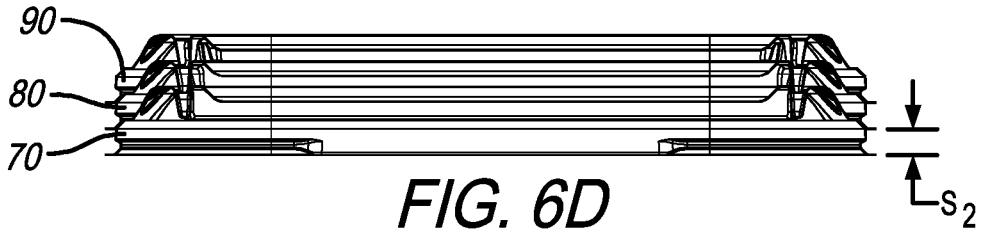
FIG. 6D is a cross section of the stack of FIG. 6C, taken along the line 6D-6D thereof.

As perhaps best shown in the zoomed-in views of FIGS. 5M-5O, the stacking areas 72, 82, & 92 of the lids 70, 80, & 90, respectively, differ from one another in the angular position, radial position, and location of the interruptions 73, 83 & 93 within the concave channels 74, 84 & 94. This very subtle difference provides the necessary interference to creating a definite space S2 (shown in FIG. 6D) between adjacent lids in the stack 64. The contact area between the adjacent lids 70, 80 & 90 is approximately the (relatively small) upward-facing surface area of the interruptions 73, 83, & 93.

The lids 70, 80, & 90 can have a length X2 of about 6.25", a width Y2 of about 5.25", and a depth Z2 of about 0.55". A suitable spacing S2 could be 0.21". However these exact dimensions are not required—the lid could be bigger or smaller, and/or the spacing could be different without departing from my invention.

While the preceding discussion of my invention uses the particular embodiments of lids 70, 80, & 90, the invention could be practiced with other thermoformed products, such as cup lids, trays, or plates. While the exemplary lids 70, 80, & 90 are made to cover a simple tray with a single internal cavity, this particular structure is not required. For example, a lid according to my invention could be provided for a tray with a different number of cavities. As used herein, including the claims, the term "lid" is intended to encompass any thermoformed structure including a lid, cup, plate, or tray.

While the exemplary lids 70, 80, & 90 are rectangular, this is not required and other shapes such as round, oval, or square could be used. While the exemplary lids 70, 80, & 90 include concave channels 74, 84, & 94 that are located along the periphery of the lids, this placement is not required and the channels 74, 84, & 94 could be placed elsewhere. For example, the channels could be in the middle of the lid, with multiple parallel channels or crossed channels to enhance rigidity.

While the exemplary lids 70, 80, & 90 each include four stacking areas 72, 82, & 92, and four interruptions 73, 83, & 93, this is not required and a greater or lesser number of stacking areas and/or interruptions could be used.

The lids 70, 80, & 90 are preferably made using thermoforming methods, from a suitable sheet 60 of thermoformable material. For example, lids 70, 80, & 90 meant for use with ready-to-eat foods might be formed of a thermoformable plastic such as oriented polystyrene (OPS), talc-filled polypropylene (TFPP), polypropylene (PP), high impact polystyrene (HIPS), polyethylene terephthalate (PET), amorphous PET (APET), crystalline polyethylene (CPET) polystyrene copolymer blends, styrene block copolymer blends, and the like.

It is understood that the invention is not confined to the embodiments set forth herein as illustrative, but embraces all such forms thereof that come within the scope of the following claims.

What is claimed is:

1. A kit of thermoformed lids comprising a first lid having a plurality of first stacking areas, each first stacking area formed as at least one first interruption at a first angular position in a first concave channel;

a second lid having a plurality of second stacking areas, each second stacking area formed as at least one second interruption at a second angular position in a second concave channel; and a third lid having a plurality of third stacking areas, each third stacking area formed as at least one third interruption at a third angular position in a third concave channel;

wherein the first angular position, the second angular position, and the third angular position differ from one another;

whereby the first lid, the second, lid, and the third lid are spaced apart because of the interference between the first stacking area, the second stacking area, and the third stacking area when nested together.

2. The kit of thermoformed lids of claim 1 wherein the first concave channel is located along the periphery of the first lid, the second concave channel is located along the periphery of the second lid, and the third concave channel is located along the periphery of the third lid.

3. The kit of thermoformed lids of claim 1 wherein each lid contains four stacking areas equally spaced from a center of the lid and located along the periphery of the lid.

4. The kit of thermoformed lids of claim 1 wherein each lid contains four stacking areas, each stacking area formed as a single interruption.

5. The kit of thermoformed lids of claim 1 wherein each lid is rectangular with four corners, and each lid having four stacking areas, each stacking area located at a corner and formed as a single interruption.

6. A stack of thermoformed lids comprising at least one first lid with a plurality of first stacking areas, each first stacking area formed as at least one first interruption at a first location in a first trench;

at least one second lid with a plurality of second stacking areas, each second stacking area formed as at least one second interruption at a second location in a second trench; and at least one third lid with a plurality of third stacking areas, each third stacking area formed as at least one third interruption at a third location in a third trench;

wherein the first location, the second location, and the third location differ from one another;

whereby the first lid, the second, lid, and the third lid are spaced apart because of the interference between the first stacking area, the second stacking area, and the third stacking area when nested together.

7. The stack of claim 6 wherein the first trench is located along the periphery of the first lid, the second trench is located along the periphery of the second lid; and the third trench is located along the periphery of the third lid.

8. The stack of claim 6 wherein each lid contains four stacking areas equally spaced from a center of the lid and located along the periphery of the lid.

9. The stack of claim 6 wherein each lid contains four stacking areas, each stacking area formed as a single interruption.

10. The stack of claim 6 wherein each lid is rectangular with four corners, and each lid having four stacking areas, each stacking area located at a corner and formed as a single interruption.

11. A kit of thermoformed lids comprising a first lid having a plurality of first stacking areas, each first stacking area formed as at least one first interruption at a first radial position in a first concave channel;

a second lid having a plurality of second stacking areas, each second stacking area formed as at least one second interruption at a second radial position in a second concave channel; and a third lid having a plurality of third stacking areas, each third stacking area formed as at least one third interruption at a third radial position in a third concave channel;

wherein the first radial position, the second radial position, and the third radial position differ from one another;

whereby the first lid, the second, lid, and the third lid are spaced apart because of the interference between the first stacking area, the second stacking area, and the third stacking area when nested together.

12. The kit of thermoformed lids of claim 11 wherein the first concave channel is located along the periphery of the first lid, the second concave channel is located along the periphery of the second lid, and the third concave channel is located along the periphery of the third lid.

13. The kit of thermoformed lids of claim 11 wherein each lid contains four stacking areas equally spaced from a center of the lid and located along the periphery of the lid.

14. The kit of thermoformed lids of claim 11 wherein each lid contains four stacking areas, each stacking area formed as a single interruption.

15. The kit of thermoformed lids of claim 11 wherein each lid is rectangular with four corners, and each lid having four stacking areas, each stacking area located at a corner and formed as a single interruption.

* * * * *